US005393074A

United States Patent [19]

Bear et al.

[11] Patent Number: 5,393,074

[45] Date of Patent: Feb. 28, 1995

[54] MODULAR ELECTRONIC GAMING SYSTEM

[76] Inventors: Thomas Bear, 6559 Kolb; Robert Jordan, 15402 Angelique, both of, Allen Park, Mich. 48101

[21] Appl. No.: 254,129

[22] Filed: Jun. 6, 1994

Related U.S. Application Data

[63] Continuation-in-part of Ser. No. 116,507, Sep. 7, 1993, Pat. No. 5,320,362.

[51] Int. Cl.[6] ..... A63B 71/02

[52] U.S. Cl. ..... 273/440; 472/62; 472/66

[58] Field of Search ..... 273/440, 445, 459, 460; 434/226; 472/62, 66

[56] References Cited

U.S. PATENT DOCUMENTS

| | | | |
|---|---|---|---|
| 4,168,115 | 9/1979 | Russell et al. | 353/42 |
| 4,695,058 | 9/1987 | Carter, III et al. | 273/311 |
| 4,861,270 | 8/1988 | Ernst et al. | 434/226 |
| 4,983,124 | 1/1991 | Ernst et al. | 434/226 |
| 5,127,657 | 7/1992 | Ikezawa et al. | 273/310 |
| 5,203,707 | 4/1993 | Musto et al. | 434/226 |
| 5,219,316 | 6/1993 | Huffman | 472/62 |
| 5,320,362 | 6/1994 | Bear et al. | 273/440 |

*Primary Examiner*—William H. Grieb

*Attorney, Agent, or Firm*—Gifford, Krass, Groh, Sprinkle, Patmore, Anderson & Citkowski

[57] ABSTRACT

A modular, interactive gaming system which may be reconfigured to play a variety of participatory games. The system includes a plurality of interconnectable modules which may be combined to define passageways and gaming rooms in a variety of living game board configurations. Sensors and sensory signal generators are disposed in the passageways and gaming rooms which are in communication via a cable network with a control computer which directs the play of the game in accord with a program resident therein. The combination of modular units and a programmable computer permits great flexibility in game design and play.

12 Claims, 3 Drawing Sheets

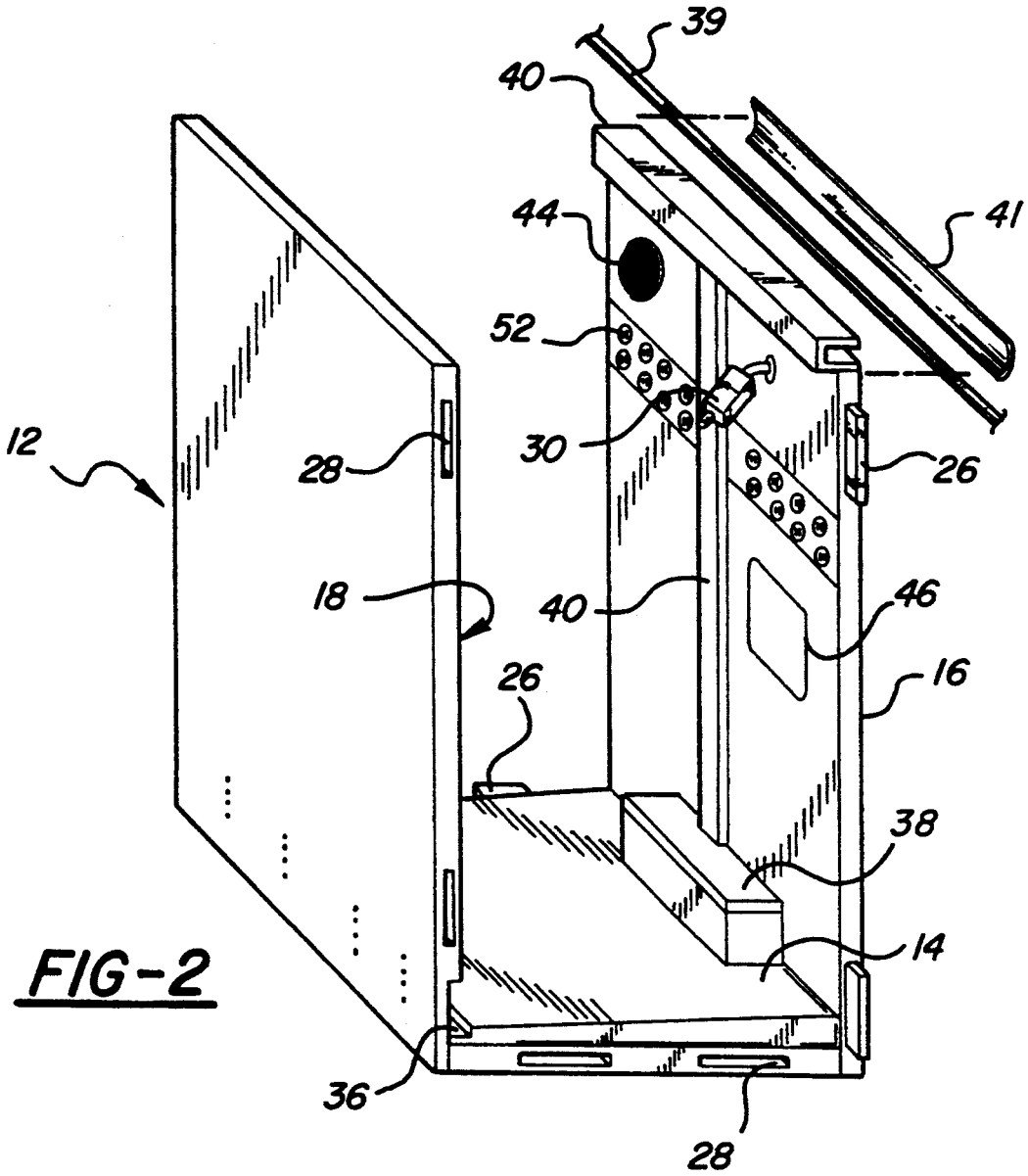
FIG-2
FIG-3
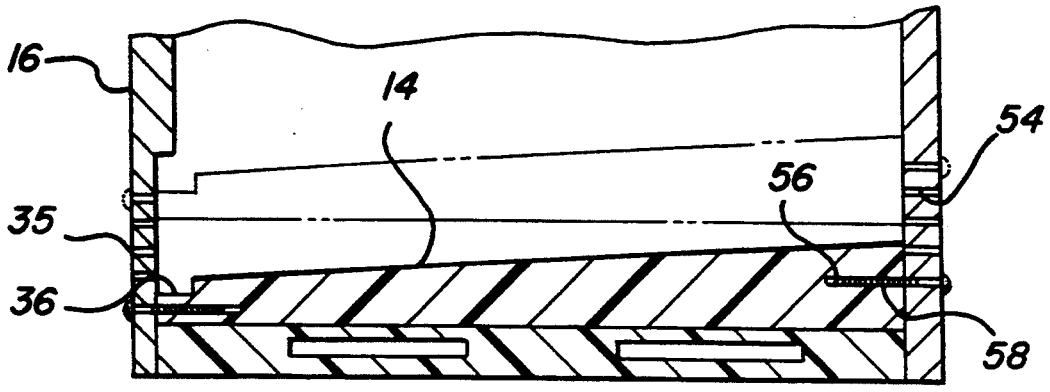

MODULAR ELECTRONIC GAMING SYSTEM

CROSS-REFERENCE TO RELATED APPLICATIONS

This application is a continuation-in-part of U.S. application Ser. No. 116,507, filed Sep. 7, 1993, now U.S. Pat. No. 5,320,362.

FIELD OF THE INVENTION

This invention relates to the field of electronic amusement systems and, more particularly, to a modular system employing a programmable computer such that the system may be employed to play a variety of participatory games.

BACKGROUND OF THE INVENTION

Board games of various types enjoy almost universal popularity. While some board games (such as chess, checkers, backgammon, etc.) depend entirely upon the playing skills of the participants, many types of popular games involve randomizing or chance factors that are built into the play of the game. In particular, many games base the movement of the players around the board on the results of numbers randomly generated by the use of dice, spinners, etc. Many others also introduce chance factors by means of "cards" or other tokens which a player receives upon the occurrence of a random event; these cards usually provide further movement instruction, or various kinds of rewards and penalties.

In recent years, many types of board games have also included devices manipulated by the various players in a manner which tests their physical skills. For example, a game may include a set of lever operated amusement devices so that players compete in their ability to flip tokens around into various locations or goals. Such games may also combine more traditional board activities.

Yet another type of game that has enjoyed increasing popularity in recent years are games which actually involve the full body, physical participation of players. These games range from so-called "living chess boards" to games where players interact physically by manipulating their body parts onto various locations of a full sized game playing surface.

Devices such as video games, arcade games, and new technology such as "virtual reality" have come into wide use both in public places and in homes all around the world. Common to most of these electronic based games is a challenge to the operator to achieve a high score; in some cases the operator has an opportunity to achieve an ultimate victory, thus "beating the game." Often, there are levels of progression which are intended to increase the degree of the challenge and entice the player to continue playing the game. Virtually all of these games allow the player to oppose a computer that operates the games so that a single individual can participate without a requirement for a second participant. Some of these games allow two or more individuals to compete against one another. This entertainment industry is a growing, booming business.

There is a trend in the electronic amusement game industry toward greater sensory involvement by the participant. The concept which has become known as "virtual reality" utilizes greater degrees of visual and audible sensory input to the participant, thus creating the illusion of an artificial, three-dimensional gaming environment.

Some major problems exist with most of these electronic games in their current form. Unlike traditional games such as chess or backgammon, they tend to involve very little mental challenge. Furthermore, they involve virtually no physical activity beyond the pushing of a few buttons or a joy stick. Thus, there are natural limitations which are inherent in this medium. The typical video game (arcade or home entertainment version) utilizes a computer which has a speaker for audio output and a color CRT for visual output. The player is forced to play the game within arms length distance. The player controls the input to the game, usually by pushing buttons or operating a joy stick; in the arcade version, these input devices are attached to the game, itself, and in the home versions by a cable.

While there are definite physical and sensory limitations inherent in the design of the typical electronic video game, there are significant advantages in that new games can be designed and produced quickly and economically because most of the development involves software design. Once the software is written, it can be loaded either directly into a computer disk drive or burned into ROM memory and inserted into the computer. Thus, both home-based and arcade-based electronic video games are relatively easy to reprogram and reformat to meet changing tastes. Because development costs are small and profitable returns realizable, there is a proliferation of electronic video games which require virtually no physical involvement by the participant.

There are only a few computer-based games that require the participant to be more physically involved. One such game is a simulated golf game which allows the participant to use golf clubs to hit a ball in the direction of a large video screen. U.S. Pat. No. 4,168,115 is representative of prior art describing this type of game. The impact on the ball when it is hit by the player feeds information to a computer, which then generates a video representation of the shot. The participant's golf skills impact directly on his or her performance which is monitored by the computer. While having the advantage of permitting true physical participation with a user-dependent outcome, simulated golf games do suffer from the disadvantage that the development and manufacturing costs of the games tend to limit their marketability, particularly because they are not affordable for home use. Furthermore, they are limited because of their inflexibility; that is, a computer-based, projection golf game will always be a golf game though software upgrades may make it possible to add variety or to enhance the appeal of the game to the end user. This inflexibility is a detraction for potential users.

U.S. patent application Ser. No. 116,507 (U.S. Pat. No. 5,320,362), in the name of the present inventors and the disclosure of which is hereby incorporated by reference, discloses an amusement system which attempts to overcome some of the disadvantages noted in the prior art above. The application discloses an amusement system for use by one or more participants which includes weapons which may be carried by the participants to fire objects such as paint balls or electromagnetic energy such as laser light. The participants wear sensors which generate signals when "hit" by an emission from another player. The disclosed system also includes a structure having a series of elongated passageways. Each passageway is divided by a central wall into a pair of trackways which lead from a common entrance area at one end to a gaming room area at the opposite end. A viewing area in which the activities of the participants in the gaming area may be observed is disposed adjacent to the gaming area. Sensors are disposed along the passageways and in the gaming areas to detect the positions and activities of the participants so as to provide signals which are fed to a central computer. The computer controls active displays disposed along the passageways and in the gaming area to simulate weapons and special sound and visual effects, such as explosions and the like, as well as displays which provide information to the participants as to their scores. A computer controls the playing progression of the game and generates scores based on signals from the sensors to evaluate the players.

Thus, the invention disclosed in U.S. application Ser. No. 116,507 does allow the participants to exercise their physical skills as they play a game, and also provides sensory output in a real, three-dimensional life size playing area. Furthermore, since the game is computer controlled, it has the ability to introduce both randomizing effects and also to provide the players a steadily increasing series of more difficult challenges. However, the system, while allowing for some variation of play by reprogramming the computer, does have the disadvantage of permitting the playing of only certain types of weapon-based games in the playing area. Thus, it is not really of interest to the many game players who dislike "shoot-em up" type games, or crave more variety in their game play.

Thus, there still exists a need for an amusement system for use in public places which combines the flexibility inherent in computerized video games, thus permitting the timely and economical development of "new games," yet includes the challenge of greater physical and mental involvement on the part of the participant. There also exists a need for games which may be played in real, three-dimensional life-sized space rather than in the confined space of a traditional board or a CRT screen, or even in the very artificial "virtual reality" of more sophisticated computer games.

SUMMARY OF THE INVENTION

The present invention has been designed to overcome the problems described in the prior art above. The invention is a full participation, interactive, computerized, and modular amusement system which allows the participants to play a variety of interactive, computer controlled games. The games combine the dynamics of common electronic video game concepts but with full bodily, sensory participation. The system employs a variety of prefabricated modules which connect together physically and electronically in conjunction with a network of computers which monitor and control devices within these fixtures to provide fully interactive, sensory effects for the participants. These sensory effects may involve sight, hearing, smell and feel. The prefabricated modular fixtures are geometrically designed so that an indefinite number of combinations can be assembled, in a manner similar to a model train track set. This flexibility, combined with a potentially infinite number of controlling software programs, makes the amusement system comparable to a life-sized game board which operates according to the design of the software which is operating on the network of computers that control the system. Thus, instead of the color monitor and speaker which provide sensory feedback to a video game player, with control being exercised by a joy stick, the present system provides a life-sized, fully interactive, fully sensory game board that puts the participant right into the game as a real life character.

In one embodiment of the system of the present invention, the modules are of at least three types: a plurality of interconnectable track modules are provided, each of the track modules having a floor and two side walls to define a passageway for a game participant to move therethrough; the second and third type of modules include room floor and room wall modules which may be connected together to create gaming rooms of various sizes and configurations. Each of the three types of modules is provided with at least a pair of mating first and second connector members which are disposed at first and second locations thereon such that one module may be connected to any other module by connecting a first connecting member on the one module to a second connector member on the other module. Thus, an infinite variety of gaming configurations may be formed by suitably interconnecting the various types of modules. The walls and wall modules may be conventional in design or may be simple framing provided with attachment means (such as hook and loop fastener) for attaching wall "skins" appropriate for the particular activity. For example, a wall may be covered with a skin which reaches only half way up the top portion and may remain open or be covered with a transparent skin. The skins may carry other gaming elements. This feature enhances the flexibility of the system.

A plurality of various types of sensors (such as vidicams, infrared sensors, other types of motion detectors, audio pickups, pressure sensors, etc.) are disposed along the passageways defined by the track modules and in the gaming rooms created by combining the room wall and room floor modules. These sensors are operative to generate electrical signals indicative of the positions and activities of the participants in the passageways and gaming rooms. A plurality of sensory signal generators (such as speakers, video displays, electromechanically actuated fixtures, odor generators, etc.) are also disposed along the passageways and gaming rooms. A central computer (which may be a single computer or a network of computers) is in electronic communication with the sensors and with the sensory signal generators. The computer is programmed to process the electronic signals received from the sensors and generate appropriate signals to the sensory signal generators on the basis of the received signals so as to control their operation. Thus, for example, the computer receives a signal from a motion detector sensor indicating that a participant has entered a particular gaming room; the computer may be programmed to instruct a video screen to display a set of instructions to that player. By way of another example, if the sensor indicates that a player has succeeded in putting together the pieces of a jigsaw puzzle, the computer may instruct a locked compartment in the gaming room to dispense a valuable game token to the player. The three types of modules all are wired for connection to the sensors and sensory signal generators. Each module may be interchangeably connected to any other to create a wiring network. The central computer is in communication with the wiring network to create a "smart gaming system."

In a preferred embodiment, the floors of the track modules, as well as the room floor fixtures, are provided with a trough along one edge thereof (where the floor module joins with the wall) for the receipt of various gaming pieces therein. Preferably, the floors of these modules will be sloped toward the trough so that the pieces will slide into the trough so as to leave the floor area clear for the passage of players therethrough.

A locked compartment may be provided in some or all of the track modules, as well as one or both types of room modules, and is electronically controlled by the central computer for the dispensing of various game playing pieces at appropriate times in the game and optionally depending on the skill of the player. In one embodiment, both the modules and the lockable compartments are provided with exterior cable raceways having removable covers. The various raceways are interconnectable electronically so as to create the wiring network in electronic communication with the central computer. In this way, the computer may communicate with any or all of the modules and compartments as required by the software programmed in the computer and in accordance with the play of the game as it unfolds.

Some of the plurality of track modules preferably include electronically operated doors on one or both of the walls, the operation thereof being controlled by the central computer. Some of the room wall fixtures are also provided with the electronic doors. Thus, player movement into and out of the various play areas may be controlled by the computer depending on the play of the game.

Preferably all of the modules have built-in speakers which are also controlled by the network of computers. Some of the track modules may include opposed walls so as to define a straight passageway therethrough. Others may include two adjacent walls so as to define right and left-hand turn passageways therethrough. This feature increases the flexibility of the modular system since the various straight and turn passageways and gaming rooms may be combined in a virtually infinite number of ways to create living game boards of various and diverse design.

BRIEF DESCRIPTION OF THE DRAWINGS

The following detailed description is best understood by reference to the following drawings in which:

FIG. 2 is a perspective view of a track module of the present invention showing various features thereof;

FIG. 3 is a detail view of the track module of FIG. 2 showing details of the floor construction.

DETAILED DESCRIPTION OF THE PREFERRED EMBODIMENTS

Figure 1:
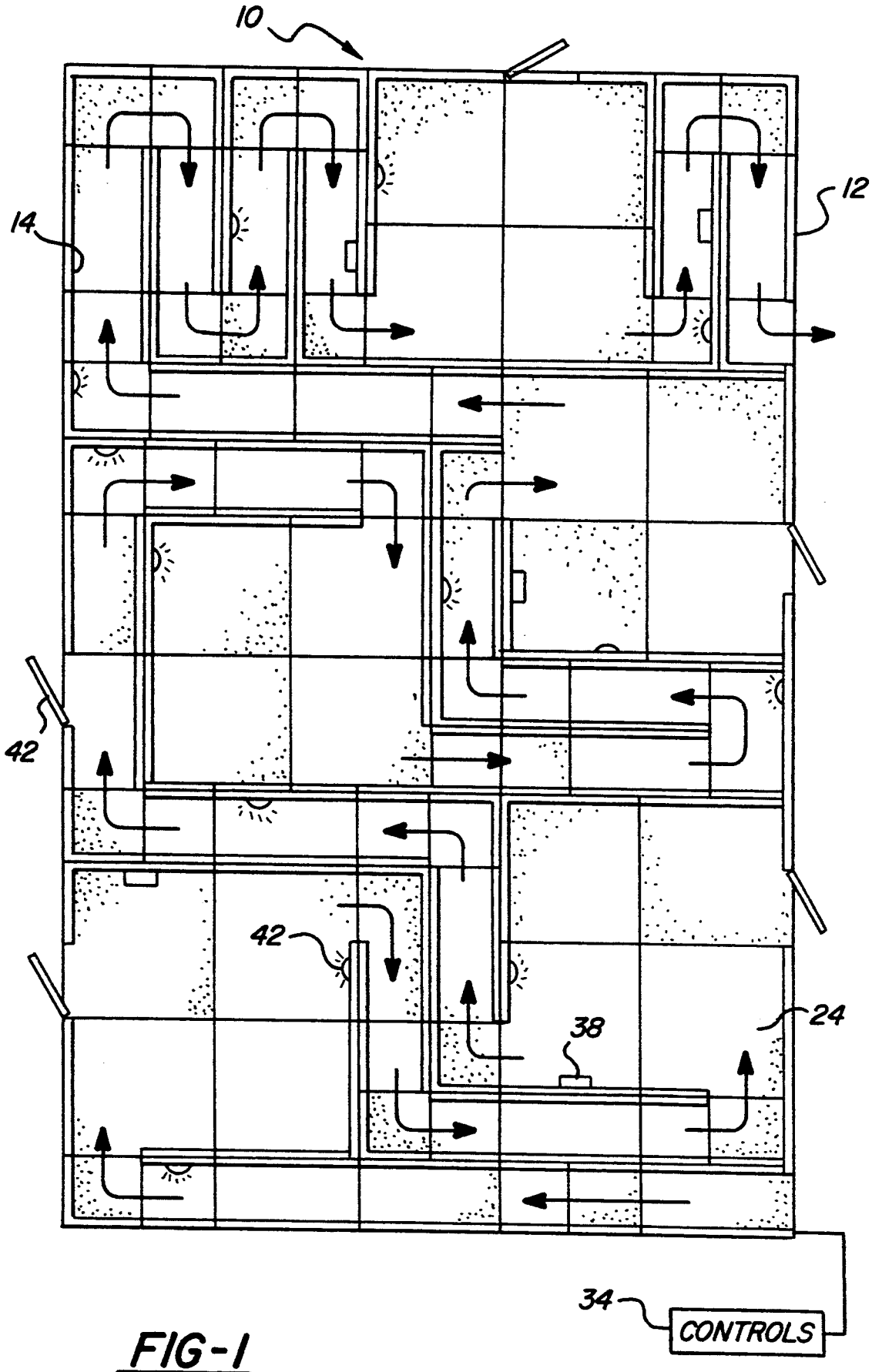
FIG. 1 is an overhead, schematic view of a living gaming board constructed using the modular system of the present invention.
Figure 4:
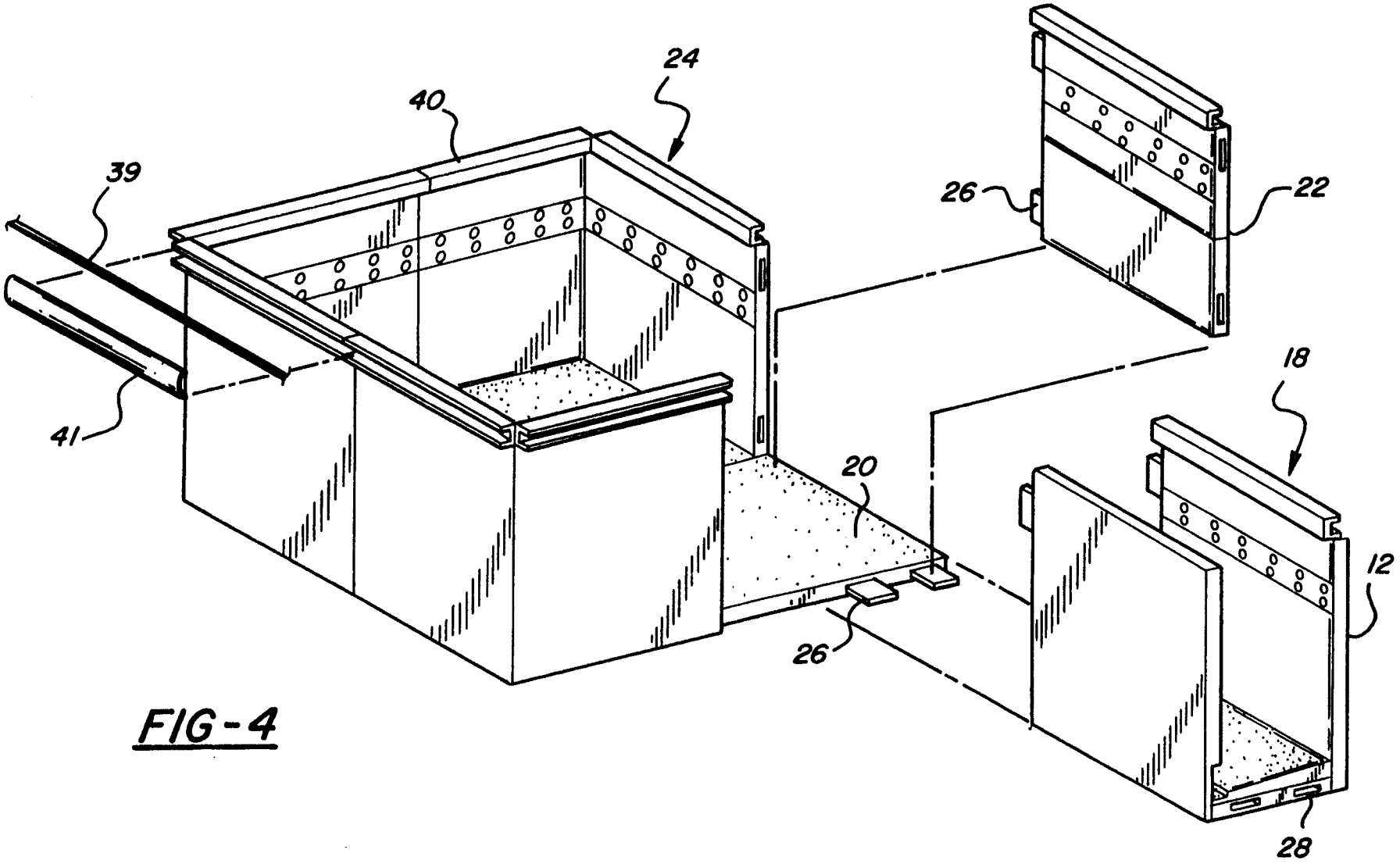
FIG. 4 is a perspective view of a gaming room and connecting passageway constructed by connecting track, room wall and room floor fixtures according to the system of the present invention.

Throughout the following detailed description, like numerals are used to reference the same element of the invention shown in multiple figures thereof. Referring now to the drawings, and in particular to FIGS. 1, 2 and 4, there is shown a modular, interactive amusement system 10 according to the present invention. The system 10 is comprised of a plurality of interconnecting modules of several types, including a plurality of track modules 12. FIG. 2 is a perspective view of a typical track module 12 having a floor 14 and opposed side walls 16 to define a passageway 18 therethrough. Although the track module 12 depicted in FIG. 2 shows opposed side walls, it is to be understood that other track modules may have a pair of adjoining side walls so as to define a corner unit which can be used to create either left or right-hand turns as required by the path the players must follow in the particular gaming configuration constructed with the system 10.

An exemplary configuration is depicted in FIG. 1 which shows an overhead view with the ceiling or roof removed. FIG. 1 includes a plurality of track modules 12, as well as a plurality of gaming rooms 24 which are constructed by using interconnecting room floor modules 20 and room wall modules 22, as can best be seen in FIG. 4. Thus, the three types of modules 12,20,22 are combined to create a plurality of gaming rooms 24 and interconnecting passageways 18. While FIG. 4 depicts a particular configuration of a gaming area constructed with the system 10 of the present invention, it is to be understood that, by differently combining and connecting the three types of modules 12,20,22, passageways 18 and gaming rooms 24 may be created which define an infinite variety of gaming areas as required by the particular play of the game for which the system 10 is employed.

All of the modules 12,20,22 are provided with a plurality of first 26 and second 28 mating connector members at various locations thereon. For example, the track module 12 depicted in FIG. 2 includes a plurality of first male connector members 26 formed along the front of the right side wall 16 and on the back edge of the floor 14, as well as a plurality of mating, second, female connectors 28 formed along the front edges of the left wall 16 and the floor 14. These first and second connector members 26,28 may be connected to corresponding connector members on others of the modules 12,20,22 to connect the modules together to form the passageways 18 and gaming rooms 24 required by the gaming area of interest.

A plurality of sensors 30, such as the vidicam shown in FIG. 2, are disposed in each of the passageways 18 and gaming rooms 24 to detect the activities of the participants playing the game. Although the sensor 30 is depicted as a vidicam, it is to be understood that it could be a different type of sensing element, such as, for example, an infrared motion detector, a microphone, a radio antenna, etc. Thus, the sensor 30 may be employed, for example, to detect the entrance of a player into a particular passageway 18 or gaming room 24.

A plurality of sensory signal generators, such as speaker 44 and/or video display screen 46, are disposed along said passageways and in said gaming rooms. Again, although the depicted sensory signal generators include a speaker and a video display screen, it is to be understood that other types of sensory signal generators may be employed (such as moving targets, odor generators, robotic figures, etc.) as required by the play of the game. In particular, the video display screen 46 is useful to communicate various types of information to the participants, such as instructions for further play, scores, etc. By using appropriate combinations of sensors 30 and sensory signal generators 44,46, the system 10 of the present invention can be used to play truly interactive games. To this end, a plurality of electrical outlets 52 are disposed in a strip along the wall 16 of the depicted track module 12 (as well as along the room wall modules 22) so that various types of sensors 30 and sensory signal generators 44,46 may be connected to the system 10 as desired. This feature increases the flexibility of the system 10.

A control computer 34 directs the play of the game by processing signals received from the sensors 30 and sending appropriate signals to the sensory signal generators 44,46. The control computer is programmable so that it may direct the play of various types of games within the system 10. Thus, the manner in which the game plays will depend upon how the control computer 34 is programmed, thus permitting great flexibility and enhanced usefulness for the system 10 of the present invention.

The control computer 34 is in electrical communication with the plurality of sensors 30 and sensory signal generators 44,46. The depicted embodiment shows a plurality of cables 39 which are disposed in each track module 12 and room wall module 22. Each cable 39 is enclosed by an external cable raceway 40 having a removable cover 41 so that the cables 39 may be accessed for easy repair. Alternatively, the cables 39 may be built into the modules.

Preferably, each track module 12 and room floor module 20 is supplied with an electronically lockable compartment 38. The electronically lockable compartment 38, which is also connected to the cable network, is used to contain various gaming tokens and pieces to which the player's access is limited by the control computer 34 according to the software programmed therein. By way of example, a player's entrance into a particular one of the passageways 18 may be sensed by a sensor 30 such as an infrared motion detector. This information is communicated to the control computer 34 by means of the cable network. The control computer 34 is programmed to send signals to the locking mechanism of the compartment 38 so to permit the player to have access to its contents. The computer 34 also sends appropriate signals to the display unit 46 instructing the player to open the compartment 38 and remove a puzzle piece contained therein. After the player has collected different puzzle pieces in various of the passageways 18, he may then be instructed to attempt to put them together; completion of that task may then permit him to enter a previously unaccessible gaming room 24.

Access to and from the passageways 18 and gaming rooms 24 may be controlled by electronically lockable doors 42 which are disposed in some of the track modules 12 and room wall units 22. The electronically lockable doors 42 operate in a manner similarly to the compartments 38; that is, a player's access to a particular gaming room 24 or passageway 18 is controlled by operation of the control computer 34 which appropriately locks and unlocks the doors 42 at appropriate places in the play of the game. Thus, in the example set forth above, the player who has collected all of the gaming piece and put them together correctly may then be permitted access to a gaming room 24 via door 42. In this manner, the computer 34 can direct movement of the participants through the living game board.

Preferably, the floors 14 and room floor modules 20 are sloped, as shown in FIGS. 2 and 3. A trough 36 is formed in each floor 14 (and room floor unit 20) proximate its juncture 35 with a wall 16 (or room wall module 22). Because of the slope of the floor, gaming pieces or tokens which would otherwise obstruct the floor slide across the floor and into the trough 36 where they may be retrieved at the end of the game. Alternatively, the trough 36 may also be used to store various gaming pieces and tokens depending on the particular game being played.

In another preferred embodiment, the floors 14 of the track modules 12 may be adjustable in height, as can most clearly be seen in FIG. 3. A plurality of bores 54 are provided in the walls 16. Apertures 56 are formed in the floors 14 which may be aligned with the desired one of the bores 54 so as to raise and lower the height of the floor 14. Pins 58 are used to fix the position of the aligned bores 54 and apertures 56. In FIG. 3, a lowered position of the floor 14 is depicted in solid lines, and a raised position in phantom.

In addition to the sensors and display units disposed in the passageway and gaming rooms, the players may also interact with the programmed central computer by sensors and signal devices carried on their persons. For example, players might wear helmets with speakers which provide them with an interactive instruction or game play. They may carry electronic targets on their clothing which emit signals when hit which may be picked up by a room sensor and communicated to the central controller. There are many possibilities for varying play.

Thus, a modular, interactive gaming system has been described which allows participants to play a variety of quite different games on a living gaming board, with full interaction between the players and the computer controlling the play of the game. The flexibility of the system of the present invention permits it to be used to create and play a variety of types of board games, including strategy games, simulation games, fantasy games, action games, etc. The uses to which the system of the present invention may be put depends solely upon the creativity of the game creator and the programming abilities of the software developer.

The present invention has been described with regard to certain embodiments and exemplifications thereof. Various modifications and variations may occur to one skilled in the art, having the benefit of the teachings of the present disclosure, without departing from the scope of the invention. Thus, it is the claims appended hereto and all reasonable equivalents thereof, rather than the exact depicted embodiments and exemplifications, which define the true scope of the present invention.

We claim:

1. A modular, interactive amusement system comprising:

a plurality of interconnectable modules, each of said modules including at least one pair of mating first and second connector members disposed at first and second locations thereon such that one of said plurality of modules may be connected to another of said plurality of modules by connecting a first connector member of said one such module with a second connector member on said another module;

a first portion of said plurality of interconnectable modules including a floor and side walls to define a track module including a passageway for game participants to pass therethrough;

a second portion of said interconnectable modules further including a floor to define a room floor fixture;

a third portion of said plurality of interconnectable modules further including a wall and defining a room wall fixture, said room wall fixtures being interconnectable with said room floor fixtures to define a gaming room in which said game participant may engage in various activities;

a plurality of sensors disposed along said passageways and said gaming rooms and operative to generate electrical signals indicative of the positions and activities of said participants in the passages and gaming rooms;

sensory signal generators disposed along said passageways and in said gaming rooms; and a central computer connected to said sensors so as to receive said electrical signals therefrom and connected to said sensory signal generators so as to control their operation, said computer being programmed to control the operation of the sensor signal generators as a preprogrammed function of the electrical signals generated by said sensors.

2. The system of claim 1 wherein the track module and room floor module floors are sloped.

3. The system of claim 2 wherein said floors further include a trough formed along an edge thereof proximate a wall junction, said floor sloping toward said trough such that a loose gaming piece will slide along said floor and into said trough so as to not to impede said passageways.

4. The system of claim 1 wherein the track modules and room wall modules further include a cable for electrical interconnection with other cables disposed on other modules so as to form a control cable network, said computer being in electronic communication with said control cable network.

5. The system of claim 1 wherein the cable is disposed in an external cable raceway attached to the module.

6. The system of claim 1 wherein at least some of said plurality of modules further include built-in speakers controlled by said computer.

7. The system of claim 1 wherein at least some track modules and some room wall modules are equipped with electronically lockable doors, said doors being controlled by said computer.

8. The system of claim 1 wherein at least some modules further include an electronically lockable compartment for the storage and controlled release of gaming tokens and equipment, said compartments being controlled by the computer.

9. The system of claim 1 wherein the floors are adjustable in height.

10. The system of claim 1 wherein at least some modules further include video display units controlled by the computer.

11. The system of claim 1 wherein said sensory signal generators include displays and said computer is further programmed to score the performance of the participants based on signals received from said sensors and to communicate the performance scores to the participants through the displays.

12. A modular, interactive amusement system comprising:

a plurality of interconnectable modules having a plurality of configurations such that said modules may be interchangeably interconnected in a plurality of ways to form game playing areas of varied design;

a plurality of sensors disposed in said plurality of modules and operative to generate electrical signals indicative of the positions and activities of participants in the game playing areas;

a plurality of sensory signal generators disposed in said modules and operative to generate sensory signals responsible to said electrical signals; and a central computer in communication with said sensors and said sensory signal generators, said computer being programmed to control operation of said sensory signal generators in response to the electrical signals generated by said sensors, said computer being further programmable to control said sensors and said sensory signal generators such that any one of a plurality of interactive game formats may be played in said system.

* * * * *